United States Patent [19]

Payne, Jr. et al.

[11] 4,433,869

[45] Feb. 28, 1984

[54] BABY WALKER

[75] Inventors: Rex E. Payne, Jr., Elverson; Ronald R. Hoffman, Morgantown, both of Pa.

[73] Assignee: Dawn Designs, Inc., Elverson, Pa.

[21] Appl. No.: 216,593

[22] Filed: Dec. 15, 1980

[51] Int. Cl.[3] ..... A47D 13/04; A61H 3/04; A63C 3/04

[52] U.S. Cl. ..... 297/5; 108/119; 248/164; 248/423; 280/650; 297/18; 297/136

[58] Field of Search ..... 297/5, 18, 136, 345; 108/119, 118, 144, 145, 146, 117, 116, 120; 248/423, 164, 408, 409; 280/647, 649, 650

[56] References Cited

U.S. PATENT DOCUMENTS

| | | | |
|---|---|---|---|
| 260,210 | 6/1882 | King | 108/146 X |
| 544,603 | 8/1895 | Thompson | 108/119 |
| 2,663,102 | 12/1953 | Olander | 108/117 |
| 2,806,747 | 9/1957 | Jaeger | 108/117 X |
| 2,834,401 | 5/1958 | Tanner | 248/423 |
| 2,958,873 | 11/1960 | Ferneau | 108/117 X |
| 3,145,048 | 8/1964 | Dowdy et al. | 280/650 X |
| 3,504,927 | 4/1970 | Seki | 280/650 X |
| 4,019,756 | 4/1977 | Ishida | 297/5 |
| 4,032,103 | 6/1977 | Ehrichs | 248/423 |

FOREIGN PATENT DOCUMENTS

| | | | |
|---|---|---|---|
| 925214 | 3/1947 | France | 297/5 |
| 409276 | 9/1966 | Switzerland | 108/119 |
| 23196 | of 1910 | United Kingdom | 248/423 |
| 135731 | 3/1919 | United Kingdom | 108/146 |

*Primary Examiner*—James T. McCall

*Attorney, Agent, or Firm*—Seidel, Gonda, Goldhammer & Panitch

[57] ABSTRACT

A tray and seat are adjustable vertically with respect to a base on a baby walker. Connecting means extending from the tray to the base is associated with a pawl having teeth meshed with a rack on the bottom surface of the tray. The meshed teeth are shaped so that the tray and seat can be elevated with respect to the base only by applying an upward force on the tray.

10 Claims, 5 Drawing Figures

BABY WALKER

BACKGROUND

The present invention is directed to a baby walker of the type disclosed in U.S. Pat. No. 4,019,756. Before elevating the tray and seat with respect to the base in said patent, it is necessary to manually disconnect the latching means as shown in FIGS. 8 and 9 of said patent. Similar manipulations are required when it is desired to lower the seat and tray with respect to the base in said patent. If a mother is holding a baby in one hand, she only has one free hand tp perform such manipulations. The present invention solves that problem by providing a baby walker wherein no manipulations are required in order to elevate the tray and seat with respect to the base.

The baby walker in said patent provides longitudinal slots 18 in the side walls of the base for slideably receiving the ends 28 of struts. From a production cost viewpoint, such slots and ends are costly. From an engineering structural point of view, the interrelationship of components is a weak construction. The bottom surface of the slot 18 is a separate element secured to the bottom surface of the base and absorbs all of the downward pressure in a direction parallel to fasteners associated therewith. The ends of struts reciprocate along a straight line whereas the slot 18 lies along a curved portion of the bias.

The present invention solves that problem in a simple, reliable and inexpensive manner.

SUMMARY OF THE INVENTION

The baby walker in accordance with the present invention includes a tray and seat adjustable vertically as a unit with respect to a base by connecting means extending therebetween. At least one rack having teeth thereon is connected to the bottom surface of the tray. At least one pawl is slideably supported with respect to the connecting means adjacent said rack. The pawl has a tooth spring biased into mesh with one of the teeth on the rack. The meshed teeth are shaped so that the tray and seat can be elevated with respect to the base by applying only an upward force on the tray so as to cause the tooth on the pawl to slide along teeth on the track.

It is an object of the present invention to provide a baby walker which may be elevated from a collapsed position by applying only an upward force on an upper portion of the baby walker.

It is another object of the present invention to provide a baby walker wherein a tray and seat is adjustable vertically with respect to a baby using only one hand.

It is another object of the present invention to provide a baby walker wherein a tray and seat is adjustable with respect to a base in a simple, reliable and inexpensive manner.

Other objects and advantages of the present invention will appear hereinafter.

For the purpose of illustrating the present invention, there is shown in the drawings a form which is presently preferred; it being understood, however, that this invention is not limited to the precise arrangements and instrumentalities shown.

DETAILED DESCRIPTION

Figure 1:
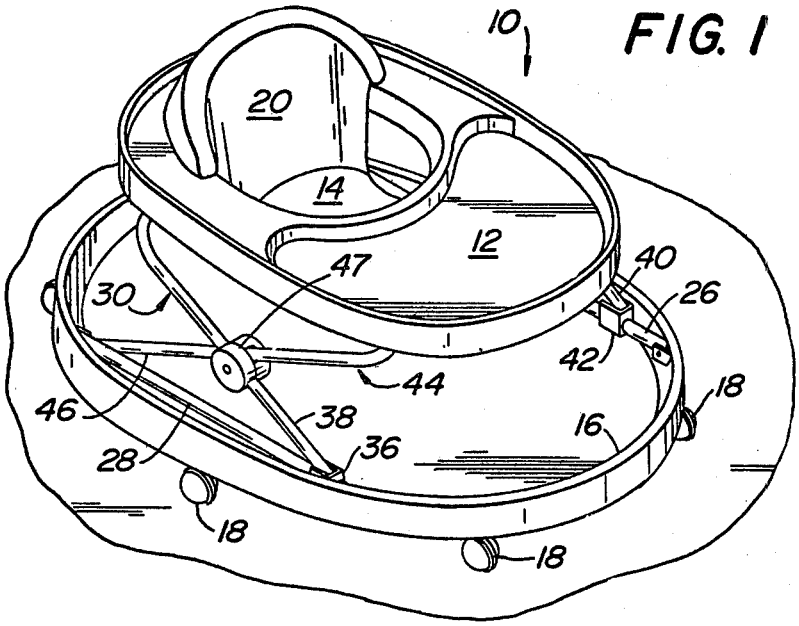
FIG. 1 is a perspective view of a baby walker in accordance with the present invention.
Figure 2:
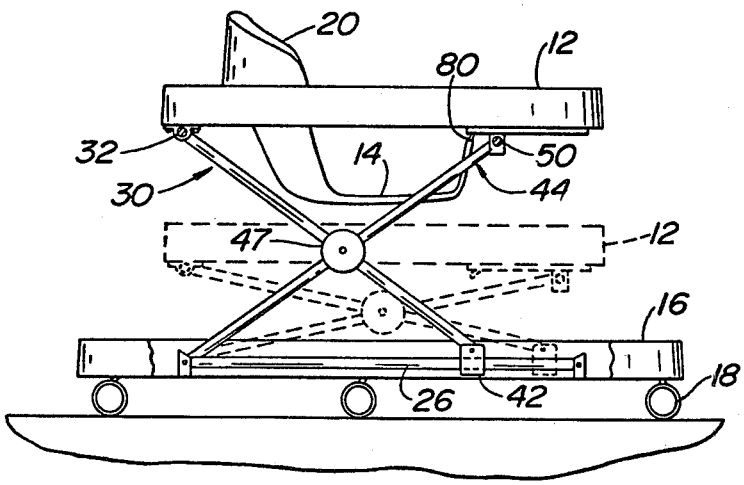
FIG. 2 is a side elevation of FIG. 1 and illustrating the walker in a collapsed position by way of phantom lines.

Referring to the drawing in detail, wherein like numerals indicate like elements, there is shown in FIG. 1 a baby walker in accordance with the present invention designated generally as 10. The baby walker 10 includes a tray 12 and a seat 14 adjustable as a unit with respect to the base 16. The base 16 is preferably oval-shaped as shown more clearly in FIG. 3 and is mounted on a plurality of caster wheels as shown more clearly in FIGS. 1 and 2. The seat 14 preferably includes a padded back 20.

Figure 3:
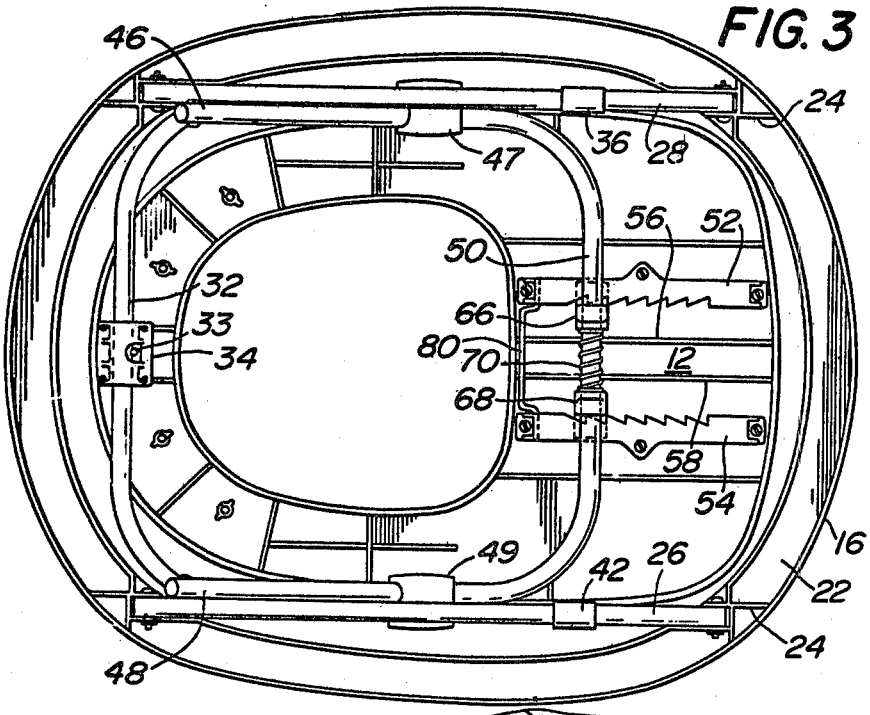
FIG. 3 is a bottom plan view of the walker shown in FIG. 1 but on an enlarged scale.

Referring to FIG. 3, the base 16 is hollow and has an open bottom 22. The opposite sides of the base 16 are interconnected at four locations by way of intersecting braces 24. The braces 24 on one side of the base 16 are bolted to a longitudinally extending guide tube 26. The braces 24 on the other side of the oval base 16 are bolted to a longitudinally extending guide tube 28. Base 16 is preferably made from a polymeric plastic while the guide tubes 26, 28 are preferably hollow steel tubes.

The tray and seat unit is coupled to the base 16 by a connecting means which permits adjustment of the elevation of the tray and seat unit to desired elevations between a maximum extending position and a collapsed position. The connecting means includes a pair of U-shaped leg members 30 and 44 pivotably connected to each other at pivots 47, 49.

The member 30 has a bight 32 which is pivotably connected to a bottom surface of tray 12 behind the seat 20 by way of a bearing 34. See FIG. 3. The tray 12 is centered on member 30 by means of a fixed projection 33 on bight 32 that is confined by bearing 34. A slide 36 preferably made from a polymeric plastic material which is selflubricating is telescoped with respect to the guide member 28 and is slideable therealong. A leg 38 of member 30 has its free end pivotably connected to the slide 36. The other leg 40 of member 30 has its free end pivotably connected to a similar slide 42 guided by tube 26.

The member 44 has one leg 46 pivotably connected at its free end to the guide tube 28 adjacent the rear end thereof. The other leg 48 of member 44 has its free end pivotably connected to the guide tube 26 adjacent the rear end thereof. The bight 50 of member 44 is adjacent to the bottom surface of the tray 12. See FIGS. 2–4.

On the bottom surface of tray 12 and forwardly of the cut-out area for receiving the seat 14, there is provided at least one and preferably two racks 52, 54. The racks 52, 54 are located on opposite sides of a pair of downwardly extending ribs 56, 58 on the tray 12. Racks 52, 54 are identical, but of opposite hand.

Rack 52 has a plurality of teeth 60. Rack 54 has a plurality of teeth 62. The teeth 60, 62 extend toward each other and are spaced from the adjacent bottom surface of the tray 12 by a notch. Rack 54 has a notch 64 on its inner surface and a comparable notch is provided on the rack 52.

A pawl 66 is associated with the rack 52. An identical pawl 68, but of opposite hand, is associated with the rack 54. Since the pawls 66, 68 are identical, only pawl 68 will be described in detail.

Figure 5:
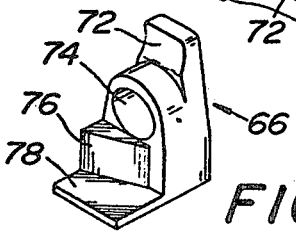
FIG. 5 is a perspective view of a pawl.

As shown more clearly in FIG. 5, pawl 66 includes a finger grip portion 72 and a tooth 76. Between tooth 76 and portion 72, pawl 66 is provided with a bore 74 therethrough. Adjacent the tooth 76, there is provided a flange 78 adapted to be received within the notch along rack 52 beneath the teeth 60.

Figure 4:
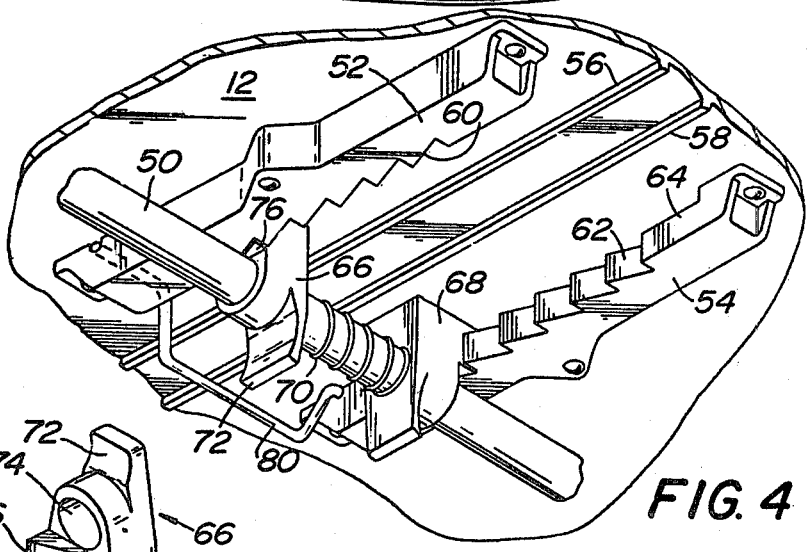
FIG. 4 is a partial perspective view of a portion of the bottom surface of the tray.

The pawls 66, 68 are assembled back-to-back as shown more clearly in FIG. 4 with their flanges in their respective notches. See FIG. 3. The bight 50 extends through the bore in each of the pawls 66, 68. Between the pawls, there is provided a spring 70 which surrounds the bight 50 and biases the pawls 66, 68 away from each other so that the tooth on each pawl is engaged with one of the teeth on the racks 52, 54. The pawls 66, 68 may be disengaged from their respective racks by a squeezing pressure using two fingers on one hand for compressing the spring 70 and moving the pawls toward each other. The ribs 56, 58 act as a limit stop to prevent the flange on each of the pawls from being withdrawn from its associated notch on the racks 52, 54.

The teeth 60, 62 and their mating teeth on the pawls are angled rearwardly toward the seat 14. When pressure is applied to the tray 12 in an upward direction, each tooth 76 is cammed inwardly, spring 70 becomes compressed, and then teeth 76 step onto the next one of the teeth 60, 62. Only an upward lifting force need be applied to the tray 12 in order to elevate the tray 12 from the collapsed phantom position shown in FIG. 2 to the elevated solid line position shown in FIG. 2 or any elevation therebetween. The elevation of tray 12 is tooth by tooth along the teeth 60, 62 with a audible clicking sound. When lifting pressure on the tray 12 is terminated, the tray 12 remains at such elevated position. The racks 52, 54 provide a convenient structure for supporting the seat hanger wire 80 which supports the front end of the seat 14. The rear end of seat 14 is supported on the tray 12.

As the tray and seat is moved from one elevation to another, the slides 36, 42 move longitudinally along the length of the guide tubes 28, 26 respectively. Since the guide tubes 26, 28 are straight, there is no binding action as the tray and seat unit ascends and descends. Whenever it is desired to cause the tray and seat unit to descend, it is only necessary to squeeze on the finger grip portions of the pawls 66, 68 whereby the tray and seat unit will descend under the effect of gravity.

The baby walker 10 is simple, easy to use and reliable. The racks 52, 54 and their associated pawls are preferably made from a polymeric plastic material capable of being injection molded. The tray 12 and base 16 are also preferably made from a similar polymeric plastic material so that they may be injection molded. While two racks and associated pawls are illustrated and described as the preferred embodiment, only one such rack and pawl may be utilized if desired. If that event, one end of the spring 70 would have to abut a stationary projection whereby the pawl would be spring biased into contact with one of the teeth on its associated rack.

The present invention may be embodied in other specified forms without departing from the spirit or essential attributes thereof and, accordingly, reference should be made to the appended claims, rather than to the foregoing specification, as indicating the scope of the invention.

We claim:

1. A baby walker comprising a tray and seat adjustable as a unit vertically with respect to a base by connecting means extending therebetween, at least one rack fixedly mounted to a bottom surface of said tray, said rack having teeth, a pawl slideably supported with respect to said connecting means adjacent said rack, said pawl having at least one tooth spring biased into meshing contact with at least one tooth on said rack, said meshed teeth being shaped so that said tray and seat can be elevated with respect to said base by applying only an upward force on the tray.

2. A baby walker in accordance with claim 1 wherein a portion of the connecting means extends through said pawl which is slideable along said connecting means in a direction so that the tooth on the pawl moves toward and away from the teeth on the rack.

3. A baby walker in accordance with claim 2 including a pair of parallel guide tubes supported by said base, said connecting means including a U-shaped leg having its bight pivotably connected to the tray and having its free ends slideably guided by said tubes.

4. Apparatus comprising a tray and seat adjustable with respect to a base therebelow and coupled thereto by leg means, the improvement comprising means to facilitate rapid changes in elevation of the tray and seat with respect to the base, said last-mentioned means including two spaced racks of teeth connected to a bottom surface of said tray, two pawls slideable between said racks and biased away from each other into contact with teeth on one of said racks, said pawls being slideably connected to a common portion of said leg means whereby the pawls may be moved toward each other for a sufficient distance to disengage from the teeth of the racks and free said common portion of the leg means so that the elevation of the tray and seat may be changed.

5. Apparatus in accordance with claim 4 wherein each pawl has a tooth meshed with a mating tooth on its associated rack, said meshed teeth being shaped so that said tray and seat can be elevated with respect to said base by applying only an upward force on said tray while each pawl tooth clicks from one tooth to the next adjacent tooth on its associated rack.

6. Apparatus in accordance with claim 5 wherein said leg means includes a U-shaped member, a pair of straight guide tubes supported by said base, each free end of said U-shaped member being slideably guided by one of said guide tubes, and the bight of said U-shaped member being pivotably connected to said tray whereby the tray remains horizontal as its elevation is changed with respect to the base.

7. A baby walker comprising a tray supporting a seat and adjustable as a unit vertically with respect to a base by connecting means extending therebetween, means for enabling said tray and seat to be elevated with respect to said base by applying only an upward force on the tray, said last-mentioned means including a pair of spaced racks adjacent one end of said tray and having their teeth facing each other, at least one limit stop on the tray between the racks, a pawl associated with each rack, each pawl being slideable away from its rack to contact with the limit stop, said pawls being spring biased away from each other into contact with teeth on their associated rack, each pawl having a bore through which a portion of the connecting means extends.

8. A baby walker in accordance with claim 7 including a pair of parallel guide tubes supported by said base, said connecting means including a first U-shaped leg having its bight pivotably connected to the tray and having its free ends slideably guided by said tubes and a second U-shaped leg having its bight as the portion extending through said pawls, the free ends of said second U-shaped leg being pivoted to the base, said U-shaped legs being pivoted to each other.

9. A baby walker in accordance with claim 7 wherein each pawl has a finger grip portion adjacent one end and a flange adjacent the other end, each flange being disposed in a notch at least partially defined by said racks.

10. A baby walker comprising a tray and seat adjustable as a unit vertically with respect to a base by connecting means extending therebetween, a pair of spaced racks connected to a bottom surface of said tray, said racks having teeth facing each other, a pawl associated with each rack, at least one limit stop on the tray between said racks, each pawl having a bore through which a portion of the connecting means extends, each pawl being slideably supported with respect to said connecting means, each pawl being slideable away from its associated rack to contact with the limit stop, said pawls being spring biased away from each other into meshing contact with teeth on their associated rack, said meshed teeth being shaped so that said tray and seat can be elevated with respect to said base by applying only an upward force on the tray.

* * * * *